US011802326B2

(12) United States Patent
Luo et al.

(10) Patent No.: US 11,802,326 B2
(45) Date of Patent: Oct. 31, 2023

(54) ANISOTROPIC BONDED MAGNET AND PREPARATION METHOD THEREOF

(71) Applicants: GRIREM HI-TECH CO., LTD., Hebei (CN); GRIREM ADVANCED MATERIALS CO., LTD., Beijing (CN); Grirem (Rongcheng) Co., Ltd., Shandong (CN)

(72) Inventors: Yang Luo, Beijing (CN); Yuanfei Yang, Beijing (CN); Zilong Wang, Beijing (CN); Dunbo Yu, Beijing (CN); Hongbin Zhang, Beijing (CN); Jiajun Xie, Beijing (CN); Zhou Hu, Beijing (CN); Zhongkai Wang, Beijing (CN)

(73) Assignees: GRIREM HI-TECH CO., LTD., Langfang (CN); GRIREM ADVANCED MATERIALS CO., LTD., Beijing (CN); Grirem (Rongcheng) Co., Ltd., Weihai (CN)

( * ) Notice: Subject to any disclaimer, the term of this patent is extended or adjusted under 35 U.S.C. 154(b) by 0 days.

(21) Appl. No.: 17/331,531

(22) Filed: May 26, 2021

(65) Prior Publication Data

US 2021/0375514 A1 Dec. 2, 2021

(30) Foreign Application Priority Data

May 29, 2020 (CN) ..... 202010476262.0

(51) Int. Cl.

| | |
|---|---|
| ***C22C 38/00*** | (2006.01) |
| ***H01F 1/057*** | (2006.01) |
| ***H01F 41/02*** | (2006.01) |
| ***B22F 7/06*** | (2006.01) |

(Continued)

(52) U.S. Cl.

CPC ..... *C22C 38/002* (2013.01); *B22F 1/102* (2022.01); *B22F 7/062* (2013.01); *C22C 38/005* (2013.01); *H01F 1/0558* (2013.01); *H01F 1/0576* (2013.01); *H01F 1/0578* (2013.01); *H01F 41/0266* (2013.01); *B22F 2202/05* (2013.01);

(Continued)

(58) Field of Classification Search

None

See application file for complete search history.

(56) References Cited

U.S. PATENT DOCUMENTS 5,641,363 A * 6/1997 Fukuno ..... H01F 1/0577 419/12
2009/0019969 A1* 1/2009 Kato ..... C22C 38/16 75/228

FOREIGN PATENT DOCUMENTS

JP 04163905 A * 6/1992 ..... H01F 1/0578
JP 2015220337 A * 12/2015

* cited by examiner

*Primary Examiner* — Xiaobei Wang

(74) *Attorney, Agent, or Firm* — Dragon Sun Law Firm, PC; Nathaniel Perkins

(57) ABSTRACT

An anisotropic bonded magnet and a preparation method thereof are provided. By stacking magnets having different magnetic properties and/or densities, the magnets in the middle have high properties and the magnets at two ends and/or the periphery have low properties, thereby compensating for a property deviation caused by a difference in pressing densities during a pressing process, and improving the property uniformity of the magnets in an axial direction. The method solves the problem of "low in the middle and high at two ends" caused by the phenomenon of non-uniform magnetic field orientation and density along a height direction during orientation and densification.

24 Claims, 1 Drawing Sheet

(51) Int. Cl.
*H01F 1/055* (2006.01)
*B22F 1/102* (2022.01)

(52) U.S. Cl.
CPC .... *B22F 2301/355* (2013.01); *C22C 2202/02* (2013.01)

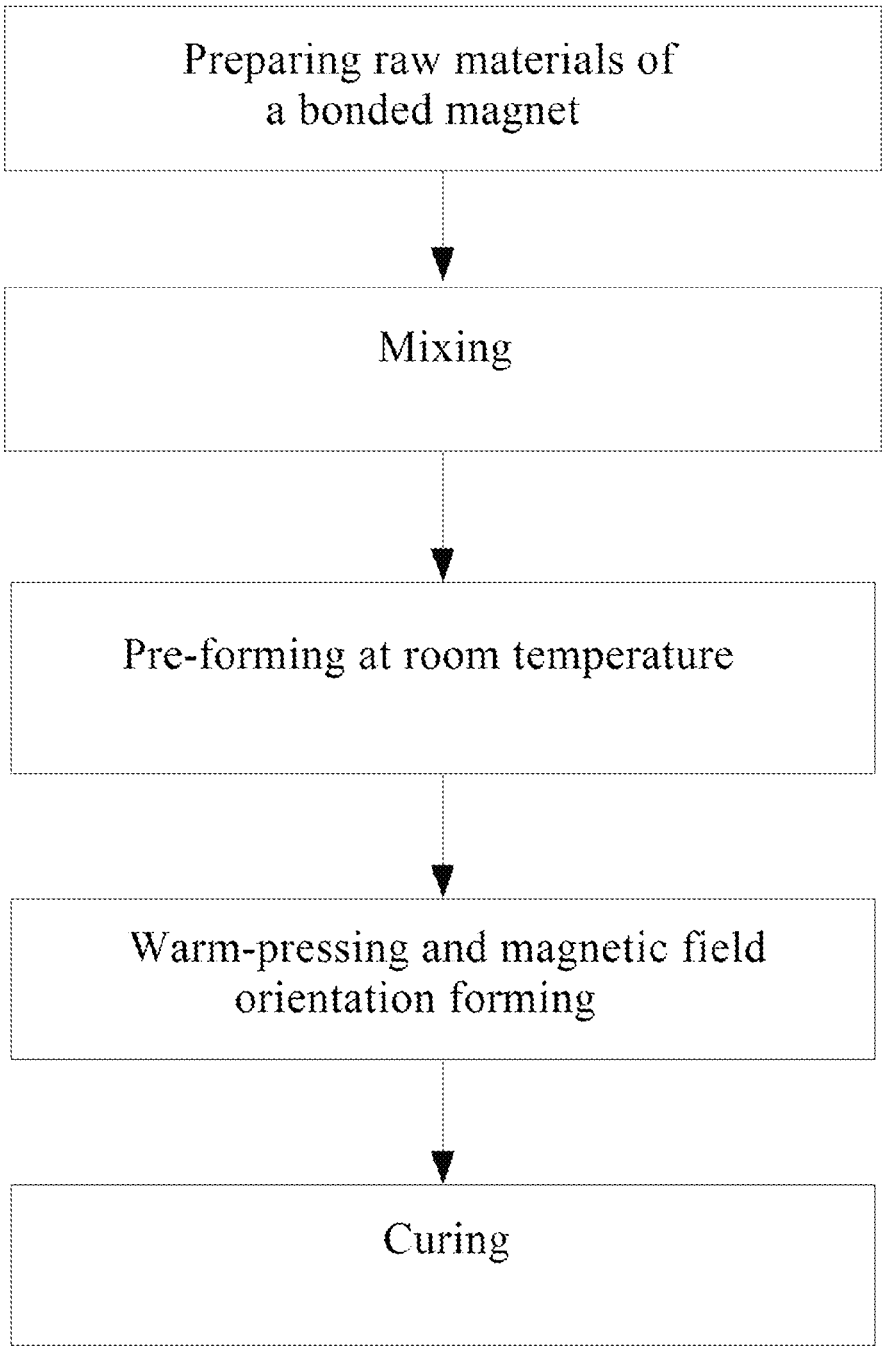
Preparing raw materials of a bonded magnet
Mixing
Pre-forming at room temperature
Warm-pressing and magnetic field orientation forming
Curing

ANISOTROPIC BONDED MAGNET AND PREPARATION METHOD THEREOF

CROSS REFERENCE TO RELATED APPLICATION

The present application is filed based on and claims priority from the Chinese Patent Application 202010476262.0 filed May 29, 2020, the content of which is incorporated herein in the entirety by reference.

TECHNICAL FIELD

The present invention relates to the technical field of bonded magnet materials, and in particular, to an anisotropic bonded magnet and a preparation method thereof.

BACKGROUND

Bonded permanent magnets have good processability and a high shape degree-of-freedom and dimensional accuracy, have no need for secondary processing and thus have become indispensable important elements of modern high-tech products and are widely used in the fields of electronic information, computers, motors, automobiles and the like. In addition, since an anisotropic bonded magnet has a more excellent magnetic property and can effectively promote miniaturization, efficiency, energy saving and light weight of electronic products, it becomes a trend of the bonded permanent magnets.

Forming methods of the bonded permanent magnet include compression molding, calendaring molding, injection molding, and extrusion molding. As the compression molded magnet has the highest magnetic property, the compression molding is the most widely used.

The basic process flow of preparing the anisotropic bonded magnet from a thermosetting resin by compression molding is as follows:

acquisition of a composite magnetic powder by mixing a magnetic powder with a binder and an additive→orienting and pressing→demagnetization→curing→anti-corrosion treatment→property detection. The additive refers to a lubricant, a coupling agent or the like; and the binder generally is a thermosetting resin such as an epoxy resin, a phenol resin, etc. An orientation forming process may have three forms: forming at room temperature, warm-pressing forming, and multi-step forming. For the anisotropic bonded magnet prepared by forming at the room temperature, the magnetic property is lower due to the lower magnet density and poor degree of orientation. In a warm-pressing forming process, the binder is softened and melted to be viscous due to high temperature, has certain lubrication effect due to its low viscosity and thus achieves the purposes of reducing both the rotation resistance of magnetic powder particles and the frictional resistance between the magnetic powder and mold walls during orientation. Further, the degree of orientation and density of the magnet are effectively increased. A warm-pressing forming technology is widely used in the preparation of anisotropic bonded magnets at present. Therefore, the key of preparing the anisotropic bonded permanent magnet is to increase the degree of orientation and density.

In the prior art, CN101599333A provides a method for manufacturing an anisotropic multi-pole magnetic ring by dry-pressing forming. In this method, a magnetic powder is subjected to wet pulverization, and one or more binders and lubricants are added to the dried magnetic powder; then pre-pressing and pre-magnetization are performed; afterwards, mixing is performed with a high-speed pulverizer; and finally, double-sided isotactic molding is performed on the above powder in a radial magnetic field.

CN101814368A provides a method of preparing an anisotropic magnet: adjusting a particle size of a powder, wherein a first mixture is composed of a first magnetic powder having a particle size of more than 20 μm and less than 150 μm, a thermosetting resin with the added amount of less than 2.0 wt. % in the anisotropic bonded magnet, and a first additive; and a second mixture is composed of a second magnetic powder having a particle size of more than 1 μm and less than 20 μm, and a second additive. The method is used to improve the magnet density and magnetic properties. However, a difference between the magnetic field intensity of a center portion and the magnetic field intensity of ends of the magnet is 5% or more.

CN103489621A provides a method of preparing an anisotropic bonded magnet by mold pressing. A two-step forming process is adopted, that is, the method is a method for preparing an anisotropic bonded magnet by pre-forming at room temperature and an orientation, densification and warm-pressing forming process. During orientation and densification, the phenomenon of non-uniform magnetic field orientation and density in a height direction exists and the phenomenon of low in the middle and high at two ends appears.

CN107393709A provides a method of preparing an anisotropic bonded magnet having a high degree of orientation by cold isostatic pressing. In this method, a thermosetting resin and a curing agent are prepared into a binder, an anisotropic bonded magnetic powder is added to a binder solution, the mixture is fully stirred before being injected into a silicone mold for vacuum sealing, orientation is performed at a magnetic field of 1.5-2 T, and then the magnet is prepared by cold isostatic pressing.

In industrial production, for magnetic rings having a high aspect ratio, an existing technology of directly filling a mold cavity with a magnetic powder in a high-temperature magnetic field will lead to the larger height of the magnetic powder in the mold cavity. As a result, it is easy to cause the non-uniform magnetic field orientation along the height direction. In addition, the heating of the mixed magnetic powder during filling at the high temperature easily causes the phenomenon of adhesion of the magnetic powder to the wall, and thus it is difficult to ensure uniformity of the filler. Consequently, the uniformity of the magnetic properties and dimensional accuracy of the magnet are affected.

SUMMARY

The object of the present invention lies in that for the problem of property non-uniformity caused by the phenomenon of low density in the middle and high density at two ends or the periphery in an axial direction in the process of preparing a magnet having a high aspect ratio, a method of stacking a plurality of magnets is adopted, and the magnets in the middle have high properties and the magnets at two ends and/or the periphery have low properties, thereby compensating for a property deviation caused by a difference in densities during a pressing process, and improving the property uniformity of the magnets in the axial direction.

To achieve the above object, the present invention adopts the following solutions.

A first aspect of the present invention provides an anisotropic bonded magnet. The anisotropic bonded magnet includes an R-T-B type permanent magnetic powder, wherein R is selected from one and more rare earth elements, T includes Fe or FeCo and a small amount of transitional metal, and B is boron;

the content of R is 28-31 wt. %, the content of B is 0.9-1.1 wt. %, and the balance is T; and the anisotropic bonded magnet is formed by pressing a plurality of different preforms, and has a density deviation of less than 2% in a pressing direction.

Further, the plurality of different preforms includes preforms having different magnetic properties and/or densities.

Further, R is one element or two or more elements selected from the group consisting of Y, Pr, Nd, Pm, Sm, Eu, Gd, Tb, Ho, Er, Tm, Yb and Lu, and is preferably Nd or PrNd.

Further, the bonded magnet is a bonded magnetic ring having an aspect ratio of greater than 0.6, preferably 1.0-5.0, and further preferably 1.2-2.5, and a wall thickness of greater than 1 mm, preferably 1-20 mm, and further preferably 1-5 mm.

A second aspect of the present invention provides a preparation method of an anisotropic bonded magnet. The preparation method includes the following steps:

step 1, preparing raw materials of the bonded magnet, wherein the raw materials comprise an R-T-B type permanent magnetic powder, a thermosetting resin binder, a coupling agent and a lubricant, wherein the weight content of the R-T-B type permanent magnetic powder is 100, the weight content of the binder is 1.0%-6.0%, preferably 2.5%-3.5% of that of the R-T-B type permanent magnetic powder, the weight content of the coupling agent is 0.05%-1.0%, preferably 0.1%-0.3% of that of the R-T-B type permanent magnetic powder, and the weight content of the lubricant is 0.05%-2.0%, preferably 0.05%-0.50% of that of the R-T-B type permanent magnetic powder;

step 2, mixing: uniformly mixing the R-T-B type permanent magnetic powder in the raw materials with the thermosetting resin binder, the coupling agent and the lubricant to acquire a composite magnetic powder;

step 3, pre-forming at room temperature: putting a plurality of dried composite magnetic powders having different magnetic properties in a first mold and then placing the first mold in a magnetic field $H_1$ for press-forming to acquire a plurality of different preforms, wherein the pressing pressure is 100-600 MPa, the magnetic field $H_1$ is less than 0.15 T, and the pressing temperature is room temperature;

step 4, warm-pressing and magnetic field orientation forming: stacking and putting the plurality of different preforms in a second mold and placing the second mold in a magnetic field $H_2$ for warm-pressing forming and orientation; performing pressing again; and afterwards, performing demagnetization, cooling and demolding to acquire an anisotropic bonded magnet subjected to warm-pressing and magnetic field orientation forming, wherein the intensity of the magnetic field $H_2$ is 0.6-3 T, the pressing pressure is 300-1000 MPa, and the forming temperature is 60-200° C.; and step 5, curing: heating the anisotropic bonded magnet subjected to warm-pressing and magnetic field orientation forming to certain temperature and then performing heat preservation, wherein the heat preservation temperature is 100-200° C., preferably 120-180° C. and the heat preservation time is 0.5-2 hours.

Further, the step 2 includes:

dissolving the coupling agent metered in the above step in a corresponding organic solvent, and then uniformly mixing the same with the R-T-B type permanent magnetic powder, so that the surface of the permanent magnetic powder is coated with the coupling agent uniformly after the organic solvent is removed through volatilization; and then dissolving the metered binder and lubricant in a corresponding organic solvent, and then uniformly mixing the same with the R-T-B type permanent magnetic powder coated with the coupling agent, so that the composite magnetic powder required for preparing the bonded magnet is acquired after the organic solvent is removed.

Further, the plurality of different preforms includes a first preform and a second preform, wherein the first preform is prepared from a composite magnetic powder having a lower magnetic property, the second preform is prepared from a composite magnetic powder having a higher magnetic property, and the ratio of remanence Br of the R-T-B type permanent magnetic powder in the two composite magnetic powders is $B_{high}/B_{low}$=1.00-1.08.

Further, the plurality of different preforms includes a first preform and a second preform, wherein the first preform has a density less than that of the second preform.

Further, stacking and putting the plurality of different preforms in the second mold in the step 4 includes: putting the second preforms in the middle and the first preforms at two ends, wherein the second preforms in the middle have a length less than that of the first preforms at the two ends.

Further, stacking and putting the plurality of different preforms in the second mold in the step 4 includes: putting the second preforms in the center and the first preforms at the periphery.

Further, stacking and putting the plurality of different preforms in the second mold comprises: the densities and/or magnetic properties of the preforms arranged from the middle to two ends gradually decrease; or the densities and/or magnetic properties of the preforms arranged from the center to the periphery gradually decrease.

Further, in the step 4, a rate of gap between the preform and a warm-pressing and magnetic field orientation forming mold is 0.5-40%, preferably 3.5%-25%.

Further, the first preform and the second preform are magnetic cylinders or magnetic rings having the same shape, and the ratio of the number of the first preforms to the number of the second preforms is 1:1-10:1.

In summary, the anisotropic bonded magnet and the preparation method thereof according to the present invention are provided. By stacking magnets having different magnetic properties and/or densities, the magnets in the middle have high properties and the magnets at two ends and/or the periphery have low properties, thereby compensating for a property deviation caused by a difference in densities during the pressing process, and improving the property uniformity of the magnets in the axial direction. The method avoids the phenomenon of non-uniform magnetic field orientation and density in a height direction during orientation and densification as well as the phenomenon of low in the middle and high at two ends. The anisotropic bonded magnet prepared by this method has the characteristic that a density deviation in a pressing direction is less than 2%; and the degree of orientation and density of the magnet as well as the property uniformity and the dimensional accuracy of the magnet are effectively improved.

BRIEF DESCRIPTION OF THE DRAWINGS

FIG. 1 is a flowchart of a preparation method of an anisotropic bonded magnet according to an embodiment of the present invention.

DETAILED DESCRIPTION

For clearer descriptions of the objects, technical solutions and advantages in the present invention, the present invention is described in further detail below with reference to specific embodiments. It should be understood that the description is merely exemplary and is not intended to limit the scope of the present invention. In addition, in the following description, the description of well-known structures and technologies are omitted to avoid unnecessarily confusing the concepts of the present invention.

A first aspect of the present invention provides an anisotropic bonded magnet. The bonded magnet includes an R-T-B type permanent magnetic powder prepared by an HDDR method, wherein R is one and more rare earth elements containing Y, and T includes Fe or FeCo and a small amount of transitional metal. The content of R is 28-31 wt. %, the content of B is 0.9-1.1 wt. %, and the balance is T. The anisotropic bonded magnet is formed by pressing a plurality of different preforms, and has an aspect ratio of greater than 0.6 and a wall thickness of greater than 1 mm. A bonded magnetic ring has a density deviation of less than 2% in a pressing direction.

Further, the plurality of different preforms includes preforms having different magnetic properties and/or densities.

Further, the rare earth element R constituting the R-T-B type permanent magnetic powder of the present invention may be one element or two or more elements selected from the group consisting of Y, Pr, Nd, Pm, Sm, Eu, Gd, Tb, Ho, Er, Tm, Yb and Lu, and is preferably Nd or PrNd for reasons of cost and magnetic property.

Further, the element T constituting the R-T-B type permanent magnetic powder of the present invention is Fe or FeCo. The amount of T in average composition of the powder is the balance except other elements constituting the powder. In addition, the Curie temperature may be increased by adding Co as a replacement element of Fe, but too much Co will lead to a decrease of the residual magnetic flux density of the powder. The residual magnetic flux density Br may be increased by adding a transitional element as a replacement element of Fe, but too many transitional elements will passivate the hydrogenation reaction in an HDDR process and thus affect the magnetic properties.

Further, the bonded magnet may have many shapes, the further description is given by taking a bonded magnetic ring as an example, but it is not limited to the bonded magnetic ring. The density of the bonded magnetic ring determines its magnetic property. For a magnetic ring with an aspect ratio, a pressing process of the magnetic ring determines an axial density deviation and the density deviation will lead to the magnetic property non-uniformity of the magnetic ring in an axial direction, thereby affecting the output stability of a motor after the magnetic ring is assembled. The bonded magnetic ring according to the present invention has a density deviation of less than 2% along a pressing direction, which fully ensures the property uniformity of the magnetic ring and the output stability of the motor after assembly. The bonded magnetic ring according to the present invention has an aspect ratio of greater than 0.6, preferably 1.0-10, and further preferably 2-8. For a magnetic ring with a small aspect ratio (less than 0.6), the density deviation in the pressing direction is small, and thus this magnetic ring may be accomplished in the prior art. The too large aspect ratio (greater than 10) of the magnetic ring will bring a greater difficulty to the forming of the magnetic ring and a subsequent assembly process.

Further, the bonded magnetic ring according to the present invention has a wall thickness of greater than 1 mm, preferably 1-20 mm, and further preferably 1-5 mm. If the wall thickness of the magnetic ring is too small (less than 1 mm), it is very difficult to prepare the magnetic ring and the magnetic ring is easily damaged. If the wall thickness of the magnetic ring is too large (greater than 20 mm), as no pressing is not performed in a radial direction and the bonding strength is too weak, too large wall thickness is unfavorable for integral forming of the magnetic ring, also does not conform to the trend of light weight, and limits the assembly process and application fields of the magnetic ring.

A second aspect of the present invention provides a preparation method of an anisotropic bonded magnet for manufacturing the above anisotropic bonded magnet. A two-step forming process is adopted, that is, the method is a method for preparing an anisotropic bonded magnetic ring (in the following of the present invention, the anisotropic bonded magnet takes the magnetic ring as a specific embodiment, but is not limited to the magnetic ring structure) by pre-forming at room temperature and orientation and warm-pressing forming. A plurality of pre-pressed magnetic ring preforms having different properties is prepared by the process of pre-forming at room temperature, and in the orientation and warm-pressing forming process, the plurality of pre-pressed magnetic ring preforms are stacked and pressed, wherein the magnetic rings in the middle have high properties and the magnetic rings at two ends have low properties. Specifically, the method includes the following processes as shown in FIG. 1.

In step 1, raw materials of the bonded magnetic ring are prepared.

The raw materials of the bonded magnetic ring include an R-T-B type permanent magnetic powder, a thermosetting resin binder, a coupling agent, a lubricant and the like.

The rare earth element R constituting the R-T-B type permanent magnetic powder of the present invention may be one element or two or more elements selected from the group consisting of Y, Pr, Nd, Pm, Sm, Eu, Gd, Tb, Ho, Er, Tm, Yb and Lu, and is preferably Nd or PrNd for reasons of cost and magnetic property. The element T constituting the R-T-B type rare-earth magnet powder is Fe or FeCo. The thermosetting resin binder is a thermosetting resin such as an epoxy resin, a phenol resin, etc. The coupling agent is a silane coupling agent, titanate and the like. The lubricant is paraffin wax, stearate, silicone oil, and the like.

Based on the weight content of the R-T-B type permanent magnetic powder being 100, the weight content of the binder is 1.0%-6.0%, preferably 2.5%-3.5% of that of the R-T-B type permanent magnetic powder, the weight content of the coupling agent is 0.05%-1.0%, preferably 0.1%-0.3% of that of the R-T-B type permanent magnetic powder, and the weight content of the lubricant is 0.05%-2.0%, preferably 0.05%-0.50% of that of the R-T-B type permanent magnetic powder.

In step 2, mixing is performed: the R-T-B type permanent magnetic powder in the raw materials is uniformly mixed with the thermosetting resin binder, the coupling agent and the lubricant to acquire a composite magnetic powder.

Specifically, the coupling agent metered in the above step is dissolved in a corresponding organic solvent, and then is uniformly mixed with the R-T-B type permanent magnetic powder, so that the surface of the anisotropic magnetic powder is uniformly coated with the coupling agent after the organic solvent is removed through volatilization; and subsequently the metered binder and lubricant are dissolved in a corresponding solvent, and then are uniformly mixed with the R-T-B type permanent magnetic powder coated with the coupling agent, so that the composite magnetic powder required for preparing the bonded magnet is acquired after the organic solvent is removed.

A plurality of composite magnetic powders having different magnetic properties and/or densities is prepared.

In step 3, pre-forming at room temperature is performed.

The plurality of dried composite magnetic powders is put in a mold cavity and then the mold cavity is placed in a magnetic field $H_1$ for press-forming to acquire a plurality of different preforms, wherein the pressing pressure is 100-600 MPa, the magnetic field $H_1$ is less than 0.15 T, and the forming temperature is room temperature.

The preforms have a density of 3.6-5.5 g/cm$^3$. Since the strength of the preforms decreases with a decrease in density, when the density is lower than 3.6 g/cm$^3$, the strength of the preforms is lower and the preforms cannot be kept intact during handling; and when the density is higher than 5.5 g/cm$^3$, it is difficult to acquire a high degree of orientation during the subsequent warm-pressing and magnetic field orientation.

Specifically, there are two types of preforms, one is a composite magnetic powder (Br: 12.5-13.0 kGs) prepared from the R-T-B type permanent magnetic powder having a lower magnetic property, and the other is a composite magnetic powder (Br: 13.0-13.5 kGs) prepared from the R-T-B type permanent magnetic powder having a higher magnetic property. The ratio of Br of the R-T-B type permanent magnetic powders in the two composite magnetic powders is $B_{high}/B_{low}$=1.00-1.20, preferably 1.00-1.08.

Specifically, there are two types of preforms which include a first preform and a second preform. The first preform has a density less than that of the second preform.

Further, the first preform and the second preform are magnetic cylinders or magnetic rings having the same shape, and the ratio of the number of the first preforms to the number of the second preforms is 1:1-10:1.

In step 4, warm-pressing and magnetic field orientation forming is performed.

The plurality of demoulded different preforms is stacked and put in another mold and the another mold is placed in a magnetic field $H_2$ for warm-pressing forming and orientation, wherein the preforms having high properties are put in the middle and the preforms having low properties are put at two ends; or the preforms having high properties are put in the center and the preforms having low properties are put at the periphery; and pressing is performed again. Specifically, the densities and/or magnetic properties of the preforms arranged from the middle to two ends gradually decrease; or the densities and/or magnetic properties of the preforms arranged from the center to the periphery gradually decrease.

In the process of stacking the preforms, the preforms are positioned in such a manner that they attract one another through magnetic forces.

In the process of stacking the preforms, the middle preforms have a length less than that of upper and lower preforms. Specifically, the middle preforms have a length less than that of the preforms at each end.

The intensity of the magnetic field $H_2$ is 0.6-3 T, the pressing pressure is 300-1,000 MPa, the forming temperature is 60-200° C., and the rate of gap is 0.5-40%. From the perspective of a two-step operation process and improving the magnetic properties, the gap between the preform and a warm-pressing and magnetic field orientation forming mold is preferably 3.5%-25%.

Subsequently, demagnetization, cooling and demolding are performed to acquire an anisotropic bonded magnetic ring. Demagnetization is one of alternating current pulse demagnetization and reverse pulse demagnetization.

In step 5, curing is performed.

A curing process is that: the finally-formed preforms are heated to certain temperature and then heat preservation is performed for further improving the strength of the bonded magnetic ring. The heat preservation temperature is generally 100-200° C., preferably 120-180° C. and the heat preservation time is generally 0.5-2 hours, which may be adjusted properly based on the size of the magnetic ring.

Specific embodiments of the present invention are described below, but the present invention is by no means limited to the embodiments.

Embodiment 1

(1) Preparation of Raw Materials of Bonded Magnetic Ring

An NdFeB anisotropic permanent magnetic powder containing 29.5 wt. % of Nd, a thermosetting resin binder, i.e., an epoxy resin, a coupling agent, i.e., silane and a lubricant, i.e., zinc stearate are prepared. There are two batches of NdFeB anisotropic permanent magnetic powders, i.e., a high-property batch and a low-property batch, of which Br is 13.25 kGs and 12.75 kGs respectively.

Based on the weight content of the NdFeB anisotropic permanent magnetic powder being 100, the weight content of the epoxy resin is 3% of the weight of the NdFeB anisotropic permanent magnetic powder; the weight content of silane is 0.2% of the weight of the NdFeB anisotropic permanent magnetic powder; and the weight content of zinc stearate is 0.25% of the weight of the NdFeB anisotropic permanent magnetic powder.

(2) Mixing

The metered silane is dissolved in an organic solvent, i.e., acetone, and then is placed, together with two batches of NdFeB anisotropic permanent magnetic powders above respectively, in a vacuum mixing stirrer for uniform mixing. After the acetone is volatilized, the surface of the magnetic powder is uniformly coated with the silane. Next, the metered epoxy resin and zinc stearate are dissolved in acetone and then uniformly mixed with the NdFeB anisotropic permanent magnetic powder coated with the silane. After the acetone is volatilized, two batches of composite magnetic powders having different properties for the bonded magnet are prepared.

(3) Pre-Forming at Room Temperature

The two composite magnetic powders prepared above are dried and then put in a mold cavity and the mold cavity is placed in a magnetic field $H_1$=0 for pressing forming to acquire different preforms, wherein the pressing pressure is 350 MPa, and the densities of first preforms and second preforms are 4.75 g/cm$^3$ and 4.95 g/cm$^3$ respectively.

In this embodiment, the magnetic ring formed by pressing has an aspect ratio of 1.25 and a wall thickness of 3 mm. According to an actual situation, the ratio of the number of the first preforms to the number of the second preforms is 2:1.

(4) Warm-Pressing and Magnetic Field Orientation Forming

The above different preforms are stacked and put in another mold and the another mold is placed in a magnetic field $H_2$ (2.5 T) for warm-pressing forming and orientation, wherein the pressing pressure is 700 MPa, the forming temperature is 150° C. and a rate of gap between the preform and a mold cavity is 5%; the second preforms having high properties and higher densities are put in the middle and the first preforms having lower properties and densities are put at two ends; the first preforms have a height greater than that of the second preforms; and the plurality of preforms is positioned in such a manner that they attract one another through magnetic forces for warm-pressing, orientation and pressing forming.

Subsequently, demagnetization, cooling and demolding are performed to acquire an anisotropic bonded magnetic ring.

(5) Curing

The finally-formed preform acquired above is heated to 160° C. for curing, and this temperature is kept for 1 hour, so that the anisotropic magnetic ring is prepared.

Embodiment 2

(1) Preparation of Raw Materials of Bonded Magnetic Ring

An NdFeB anisotropic permanent magnetic powder containing 29.5 wt. % of Nd, a thermosetting resin binder, i.e., an epoxy resin, a coupling agent, i.e., silane and a lubricant, i.e., zinc stearate are prepared. There are two batches of NdFeB anisotropic permanent magnetic powders, i.e., a high-property batch and a low-property batch, of which Br is 13.25 kGs and 12.75 kGs respectively.

Based on the weight content of the NdFeB anisotropic permanent magnetic powder being 100, the weight content of the epoxy resin is 3% of the weight of the NdFeB anisotropic permanent magnetic powder; the weight content of silane is 0.2% of the weight of the NdFeB anisotropic permanent magnetic powder; and the weight content of zinc stearate is 0.25% of the weight of the NdFeB anisotropic permanent magnetic powder.

(2) Mixing

The metered silane is dissolved in an organic solvent, i.e., acetone, and then is placed, together with two batches of NdFeB anisotropic permanent magnetic powders above respectively, in a vacuum mixing stirrer for uniform mixing. After the acetone is volatilized, the surface of the magnetic powder is uniformly coated with the silane. Next, the metered epoxy resin and zinc stearate are dissolved in acetone and then uniformly mixed with the NdFeB anisotropic permanent magnetic powder coated with the silane. After the acetone is volatilized, two batches of composite magnetic powders having different properties for the bonded magnet are prepared.

(3) Pre-Forming at Room Temperature

The two composite magnetic powders prepared above are dried and then put in a mold cavity and the mold cavity is placed in a magnetic field $H_1$=0 for pressing forming to acquire different preforms, wherein the pressing pressure is 350 MPa, and the densities of first preforms and second preforms are 4.00 g/cm$^3$ and 4.17 g/cm$^3$ respectively.

Other steps are the same as those of Embodiment 1.

Embodiment 3

(1) Preparation of Raw Materials of Bonded Magnetic Ring

An NdFeB anisotropic permanent magnetic powder containing 29.5 wt. % of Nd, a thermosetting resin binder, i.e., an epoxy resin, a coupling agent, i.e., silane and a lubricant, i.e., zinc stearate are prepared. There are two batches of NdFeB anisotropic permanent magnetic powders, i.e., a high-property batch and a low-property batch, of which Br is 13.25 kGs and 12.75 kGs respectively.

Based on the weight content of the NdFeB anisotropic permanent magnetic powder being 100, the weight content of the epoxy resin is 3% of the weight of the NdFeB anisotropic permanent magnetic powder; the weight content of silane is 0.2% of the weight of the NdFeB anisotropic permanent magnetic powder; and the weight content of zinc stearate is 0.25% of the weight of the NdFeB anisotropic permanent magnetic powder.

(2) Mixing

The metered silane is dissolved in an organic solvent, i.e., acetone, and then is placed, together with two batches of NdFeB anisotropic permanent magnetic powders above respectively, in a vacuum mixing stirrer for uniform mixing. After the acetone is volatilized, the surface of the magnetic powder is uniformly coated with the silane. Next, the metered epoxy resin and zinc stearate are dissolved in acetone and then uniformly mixed with the NdFeB anisotropic permanent magnetic powder coated with the silane. After the acetone is volatilized, two batches of composite magnetic powders having different properties for the bonded magnet are prepared.

(3) Pre-Forming at Room Temperature

The two composite magnetic powders prepared above are dried and then put in a mold cavity and the mold cavity is placed in a magnetic field $H_1$=0 for pressing forming to acquire different preforms, wherein the pressing pressure is 350 MPa, and the densities of first preforms and second preforms are 5.00 g/cm$^3$ and 5.21 g/cm$^3$ respectively.

Other steps are the same as those of Embodiment 1.

Embodiment 4

(1) Preparation of Raw Materials of Bonded Magnetic Ring

An NdFeB anisotropic permanent magnetic powder containing 29.5 wt. % of Nd, a thermosetting resin binder, i.e., an epoxy resin, a coupling agent, i.e., silane and a lubricant, i.e., zinc stearate are prepared. There is only one batch of NdFeB anisotropic permanent magnetic powder, of which Br is 13.00 kGs.

Other steps are the same as those of Embodiment 1.

Embodiment 5

(1) Preparation of Raw Materials of Bonded Magnetic Ring

An NdFeB anisotropic permanent magnetic powder containing 29.5 wt. % of Nd, a thermosetting resin binder, i.e., an epoxy resin, a coupling agent, i.e., silane and a lubricant, i.e., zinc stearate are prepared. There are two batches of NdFeB anisotropic permanent magnetic powders, i.e., a high-property batch and a low-property batch, of which Br is 13.5 kGs and 12.5 kGs respectively.

Other steps are the same as those of Embodiment 1.

Embodiment 6

(1) Preparation of Raw Materials of Bonded Magnetic Ring

An NdFeB anisotropic permanent magnetic powder containing 29.5 wt. % of Nd, a thermosetting resin binder, i.e., an epoxy resin, a coupling agent, i.e., silane and a lubricant, i.e., zinc stearate are prepared. There are two batches of NdFeB anisotropic permanent magnetic powders, i.e., a high-property batch and a low-property batch, of which Br is 13.25 kGs and 12.75 kGs respectively.

Based on the weight content of the NdFeB anisotropic permanent magnetic powder being 100, the weight content of the epoxy resin is 1% of the weight of the NdFeB anisotropic permanent magnetic powder; the weight content of silane is 0.2% of the weight of the NdFeB anisotropic permanent magnetic powder; and the weight content of zinc stearate is 0.25% of the weight of the NdFeB anisotropic permanent magnetic powder.

Other steps are the same as those of Embodiment 1.

Embodiment 7

(1) Preparation of Raw Materials of Bonded Magnetic Ring

An NdFeB anisotropic permanent magnetic powder containing 29.5 wt. % of Nd, a thermosetting resin binder, i.e., an epoxy resin, a coupling agent, i.e., silane and a lubricant, i.e., zinc stearate are prepared. There are two batches of NdFeB anisotropic permanent magnetic powders, i.e., a high-property batch and a low-property batch, of which Br is 13.25 kGs and 12.75 kGs respectively.

Based on the weight content of the NdFeB anisotropic permanent magnetic powder being 100, the weight content of the epoxy resin is 6% of the weight of the NdFeB anisotropic permanent magnetic powder; the weight content of silane is 0.2% of the weight of the NdFeB anisotropic permanent magnetic powder; and the weight content of zinc stearate is 0.25% of the weight of the NdFeB anisotropic permanent magnetic powder.

Other steps are the same as those of Embodiment 1.

Embodiment 8

(1) Preparation of Raw Materials of Bonded Magnetic Ring

An NdFeB anisotropic permanent magnetic powder containing 29.5 wt. % of Nd, a thermosetting resin binder, i.e., an epoxy resin, a coupling agent, i.e., silane and a lubricant, i.e., zinc stearate are prepared. There are two batches of NdFeB anisotropic permanent magnetic powders, i.e., a high-property batch and a low-property batch, of which Br is 13.25 kGs and 12.75 kGs respectively.

Based on the weight content of the NdFeB anisotropic permanent magnetic powder being 100, the weight content of the epoxy resin is 3% of the weight of the NdFeB anisotropic permanent magnetic powder; the weight content of silane is 0.2% of the weight of the NdFeB anisotropic permanent magnetic powder; and the weight content of zinc stearate is 0.25% of the weight of the NdFeB anisotropic permanent magnetic powder.

(2) Mixing

The metered silane is dissolved in an organic solvent, i.e., acetone, and then is placed, together with two batches of NdFeB anisotropic permanent magnetic powders above respectively, in a vacuum mixing stirrer for uniform mixing. After the acetone is volatilized, the surface of the magnetic powder is uniformly coated with the silane. Next, the metered epoxy resin and zinc stearate are dissolved in acetone and then uniformly mixed with the NdFeB anisotropic permanent magnetic powder coated with the silane. After the acetone is volatilized, two batches of composite magnetic powders having different properties for the bonded magnet are prepared.

(3) Pre-Forming at Room Temperature

The two composite magnetic powders prepared above are dried and then put in a mold cavity and the mold cavity is placed in a magnetic field $H_1=0$ for pressing forming to acquire different preforms, wherein the pressing pressure is 350 MPa, and the densities of first preforms and second preforms are 4.75 g/cm$^3$ and 4.95 g/cm$^3$ respectively.

In this embodiment, the magnetic ring formed by pressing has an aspect ratio of 1.25 and a wall thickness of 3 mm. According to an actual situation, the ratio of the number of the first preforms to the number of the second preforms is 2:1.

(4) Warm-Pressing and Magnetic Field Orientation Forming

The above different preforms are stacked and put in another mold and the another mold is placed in a magnetic field $H_2$ (2.5 T) for warm-pressing forming and orientation, wherein the pressing pressure is 700 MPa, the forming temperature is 150° C. and a rate of gap between the preform and a mold cavity is 5%; the second preforms having high properties and higher densities are put in the middle and the first preforms having lower properties and densities are put at two ends; the first preforms have a height greater than that of the second preforms; and the plurality of preforms is positioned in such a manner that they attract one another through magnetic forces for warm-pressing, orientation and pressing forming.

Subsequently, demagnetization, cooling and demolding are performed to acquire an anisotropic bonded magnetic ring.

(5) Curing

The finally-formed preform acquired above is heated to 120° C. for curing, and this temperature is kept for 1 hour, so that the anisotropic magnetic ring is prepared.

After the prepared magnetic ring is magnetized, surface magnetism distribution at the upper and lower ends and in the middle is tested, and then the magnetic ring is cut into 3 segments to acquire data of densities and properties of two ends and the middle, and the axial distribution uniformity of the density and property is evaluated.

Other steps are the same as those of Embodiment 1.

Embodiment 9

(1) Preparation of Raw Materials of Bonded Magnetic Ring

An NdFeB anisotropic permanent magnetic powder containing 29.5 wt. % of Nd, a thermosetting resin binder, i.e., an epoxy resin, a coupling agent, i.e., silane and a lubricant, i.e., zinc stearate are prepared. There are two batches of NdFeB anisotropic permanent magnetic powders, i.e., a high-property batch and a low-property batch, of which Br is 13.25 kGs and 12.75 kGs respectively.

Based on the weight content of the NdFeB anisotropic permanent magnetic powder being 100, the weight content of the epoxy resin is 3% of the weight of the NdFeB anisotropic permanent magnetic powder; the weight content of silane is 0.2% of the weight of the NdFeB anisotropic permanent magnetic powder; and the weight content of zinc stearate is 0.25% of the weight of the NdFeB anisotropic permanent magnetic powder.

(2) Mixing

The metered silane is dissolved in an organic solvent, i.e., acetone, and then is placed, together with two batches of NdFeB anisotropic permanent magnetic powders above respectively, in a vacuum mixing stirrer for uniform mixing. After the acetone is volatilized, the surface of the magnetic powder is uniformly coated with the silane. Next, the metered epoxy resin and zinc stearate are dissolved in acetone and then uniformly mixed with the NdFeB anisotropic permanent magnetic powder coated with the silane. After the acetone is volatilized, two batches of composite magnetic powders having different properties for the bonded magnet are prepared.

(3) Pre-Forming at Room Temperature

The two composite magnetic powders prepared above are dried and then put in a mold cavity and the mold cavity is placed in a magnetic field $H_1$=0 for pressing forming to acquire different preforms, wherein the pressing pressure is 350 MPa, and the densities of first preforms and second preforms are 4.75 g/cm$^3$ and 4.95 g/cm$^3$ respectively.

In this embodiment, the magnetic ring formed by pressing has an aspect ratio of 1.25 and a wall thickness of 3 mm. According to an actual situation, the ratio of the number of the first preforms to the number of the second preforms is 2:1.

(4) Warm-Pressing and Magnetic Field Orientation Forming

The above different preforms are stacked and put in another mold and the another mold is placed in a magnetic field $H_2$ (2.5 T) for warm-pressing forming and orientation, wherein the pressing pressure is 700 MPa, the forming temperature is 150° C. and a rate of gap between the preform and a mold cavity is 5%; the second preforms having high properties and higher densities are put in the middle and the first preforms having lower properties and densities are put at two ends; the first preforms have a height greater than that of the second preforms; and the plurality of preforms is positioned in such a manner that they attract one another through magnetic forces for warm-pressing, orientation and pressing forming.

Subsequently, demagnetization, cooling and demolding are performed to acquire an anisotropic bonded magnetic ring.

(5) Curing

The finally-formed preform acquired above is heated to 180° C. for curing, and this temperature is kept for 1 hour, so that the anisotropic magnetic ring is prepared.

Other steps are the same as those of Embodiment 1.

Comparative Example 1

(1) Preparation of Raw Materials of Bonded Magnetic Ring

An NdFeB anisotropic permanent magnetic powder containing 29.5 wt. % of Nd, a thermosetting resin binder, i.e., an epoxy resin, a coupling agent, i.e., silane and a lubricant, i.e., zinc stearate are prepared. There are two batches of NdFeB anisotropic permanent magnetic powders, i.e., a high-property batch and a low-property batch, of which Br is 13.25 kGs and 12.75 kGs respectively.

Based on the weight content of the NdFeB anisotropic permanent magnetic powder being 100, the weight content of the epoxy resin is 3% of the weight of the NdFeB anisotropic permanent magnetic powder; the weight content of silane is 0.2% of the weight of the NdFeB anisotropic permanent magnetic powder; and the weight content of zinc stearate is 0.25% of the weight of the NdFeB anisotropic permanent magnetic powder.

(2) Mixing

The metered silane is dissolved in an organic solvent, i.e., acetone, and then is placed, together with two batches of NdFeB anisotropic permanent magnetic powders above respectively, in a vacuum mixing stirrer for uniform mixing. After the acetone is volatilized, the surface of the magnetic powder is uniformly coated with the silane. Next, the metered epoxy resin and zinc stearate are dissolved in acetone and then uniformly mixed with the NdFeB anisotropic permanent magnetic powder coated with the silane. After the acetone is volatilized, two batches of composite magnetic powders having different properties for the bonded magnet are prepared.

(3) Pre-Forming at Room Temperature

The two composite magnetic powders prepared above are dried and then put in a mold cavity and the mold cavity is placed in a magnetic field $H_1$=0 for pressing forming to acquire different preforms, wherein the pressing pressure is 350 MPa, and the densities of first preforms and second preforms are 4.75 g/cm$^3$.

In this example, the magnetic ring formed by pressing has an aspect ratio of 1.25 and a wall thickness of 3 mm. According to an actual situation, the ratio of the number of the first preforms to the number of the second preforms is 2:1.

Other steps are the same as those of Embodiment 1.

Comparative Example 2

(1) Preparation of Raw Materials of Bonded Magnetic Ring

An NdFeB anisotropic permanent magnetic powder containing 29.5 wt. % of Nd, a thermosetting resin binder, i.e., an epoxy resin, a coupling agent, i.e., silane and a lubricant, i.e., zinc stearate are prepared. There are two batches of NdFeB anisotropic permanent magnetic powders, i.e., a high-property batch and a low-property batch, of which Br is 13.25 kGs and 12.75 kGs respectively.

Based on the weight content of the NdFeB anisotropic permanent magnetic powder being 100, the weight content of the epoxy resin is 3% of the weight of the NdFeB anisotropic permanent magnetic powder; the weight content of silane is 0.2% of the weight of the NdFeB anisotropic permanent magnetic powder; and the weight content of zinc stearate is 0.25% of the weight of the NdFeB anisotropic permanent magnetic powder.

(2) Mixing

The metered silane is dissolved in an organic solvent, i.e., acetone, and then is placed, together with two batches of NdFeB anisotropic permanent magnetic powders above respectively, in a vacuum mixing stirrer for uniform mixing. After the acetone is volatilized, the surface of the magnetic powder is uniformly coated with the silane. Next, the metered epoxy resin and zinc stearate are dissolved in acetone and then uniformly mixed with the NdFeB anisotropic permanent magnetic powder coated with the silane. After the acetone is volatilized, two batches of composite magnetic powders having different properties for the bonded magnet are prepared.

(3) Pre-Forming at Room Temperature

The two composite magnetic powders prepared above are dried and then put in a mold cavity and the mold cavity is placed in a magnetic field $H_1$=0 for pressing forming to acquire different preforms, wherein the pressing pressure is 350 MPa, and the densities of first preforms and second preforms are 3.6 g/cm$^3$.

In this example, the magnetic ring formed by pressing has an aspect ratio of 1.25 and a wall thickness of 3 mm. According to an actual situation, the ratio of the number of the first preforms to the number of the second preforms is 2:1.

Other steps are the same as those of Embodiment 1.

Comparative Example 3

(1) Preparation of Raw Materials of Bonded Magnetic Ring

An NdFeB anisotropic permanent magnetic powder containing 29.5 wt. % of Nd, a thermosetting resin binder, i.e., an epoxy resin, a coupling agent, i.e., silane and a lubricant, i.e., zinc stearate are prepared. There are two batches of NdFeB anisotropic permanent magnetic powders, i.e., a high-property batch and a low-property batch, of which Br is 13.25 kGs and 12.75 kGs respectively.

Based on the weight content of the NdFeB anisotropic permanent magnetic powder being 100, the weight content of the epoxy resin is 3% of the weight of the NdFeB anisotropic permanent magnetic powder; the weight content of silane is 0.2% of the weight of the NdFeB anisotropic permanent magnetic powder; and the weight content of zinc stearate is 0.25% of the weight of the NdFeB anisotropic permanent magnetic powder.

(2) Mixing

The metered silane is dissolved in an organic solvent, i.e., acetone, and then is placed, together with two batches of NdFeB anisotropic permanent magnetic powders above respectively, in a vacuum mixing stirrer for uniform mixing. After the acetone is volatilized, the surface of the magnetic powder is uniformly coated with the silane. Next, the metered epoxy resin and zinc stearate are dissolved in acetone and then uniformly mixed with the NdFeB anisotropic permanent magnetic powder coated with the silane. After the acetone is volatilized, two batches of composite magnetic powders having different properties for the bonded magnet are prepared.

(3) Pre-Forming at Room Temperature

The two composite magnetic powders prepared above are dried and then put in a mold cavity and the mold cavity is placed in a magnetic field $H_1=0$ for pressing forming to acquire different preforms, wherein the pressing pressure is 350 MPa, and the densities of first preforms and second preforms are 5.5 g/cm$^3$.

In this example, the magnetic ring formed by pressing has an aspect ratio of 1.25 and a wall thickness of 3 mm. According to an actual situation, the ratio of the number of the first preforms to the number of the second preforms is 2:1.

Other steps are the same as those of Embodiment 1.

After the prepared magnetic ring is magnetized, surface magnetism distribution at the upper and lower ends and in the middle and a radial crushing force are tested, and then the magnetic ring is cut into 3 segments to acquire data of densities and properties of two ends and the middle, and the axial distribution uniformity of the density and property is evaluated, as shown in table 1

TABLE 1

| | Surface magnetism (kGs) | | | | Density (g/cm$^3$) | | | | |
|---|---|---|---|---|---|---|---|---|---|
| | Upper portion | Middle portion | Lower portion | Maximum surface magnetism difference | Upper portion | Middle portion | Lower portion | Maximum density difference | Radial crushing force (N) |
| Embodiment 1 | 2.53 | 2.50 | 2.51 | 1.19% | 6.02 | 5.95 | 5.99 | 1.16% | 540 |
| Embodiment 2 | 2.45 | 2.41 | 2.45 | 1.63% | 5.85 | 5.75 | 5.81 | 1.71% | 486 |
| Embodiment 3 | 2.40 | 2.37 | 2.39 | 1.67% | 6.10 | 6.00 | 6.03 | 1.64% | 534 |
| Embodiment 4 | 2.54 | 2.49 | 2.52 | 1.97% | 6.01 | 5.94 | 5.98 | 1.16% | 542 |
| Embodiment 5 | 2.55 | 2.60 | 2.53 | 1.94% | 6.03 | 5.95 | 5.99 | 1.33% | 539 |
| Embodiment 6 | 2.54 | 2.51 | 2.53 | 1.18% | 6.08 | 6.05 | 6.07 | 1.15% | 458 |
| Embodiment 7 | 2.39 | 2.36 | 2.37 | 1.26% | 5.83 | 5.75 | 5.81 | 1.37% | 563 |
| Embodiment 8 | 2.54 | 2.50 | 2.53 | 1.57% | 6.05 | 5.97 | 6.04 | 1.32% | 467 |
| Embodiment 9 | 2.38 | 2.34 | 2.36 | 1.68% | 6.03 | 5.96 | 6.01 | 1.16% | 552 |
| Comparative example | 2.54 | 2.35 | 2.53 | 7.48% | 6.02 | 5.81 | 5.99 | 3.49% | 528 |
| Comparative example 2 | 2.40 | 2.23 | 2.36 | 7.08% | 5.64 | 5.45 | 5.59 | 3.37% | 498 |
| Comparative example 3 | 2.43 | 2.32 | 2.42 | 4.53% | 6.07 | 5.90 | 6.05 | 2.80% | 551 |

In summary, for the anisotropic bonded magnet and the preparation method thereof according to the present invention, by stacking magnets having different magnetic properties and/or densities, the magnets in the middle have high properties and the magnets at two ends and/or the periphery have low properties, thereby compensating for a property deviation caused by a difference in densities during the pressing process, and improving the property uniformity of the magnets in the axial direction. The method avoids the phenomenon of non-uniform magnetic field orientation and density in a height direction during orientation and densification as well as the phenomenon of low in the middle and high at two ends. The anisotropic bonded magnet prepared by this method has the characteristic that a density deviation in a pressing direction is less than 2%; and the degree of orientation and density of the magnet as well as the property uniformity and the dimensional accuracy of the magnet are effectively improved.

It should be understood that the above specific embodiments of the present invention are merely intended to exemplarily illustrate or explain the principle of the present invention, and do not constitute a limitation to the present invention. Therefore, any modifications, equivalent replacements, improvements and the like made without departing from the spirit and scope of the present invention should be included within the scope of protection of the present invention. In addition, the appended claims of the present invention are intended to cover all changes and modifications that fall within the scope and boundary of the appended claims or equivalents of the scope and boundary.

What is claimed is:

1. An anisotropic bonded magnet, comprising an R-T-B type permanent magnetic powder, wherein R is selected from one and more rare earth elements, T comprises Fe or FeCo and a small amount of transitional metal, and B is boron;

the content of R is 28-31 wt. %, the content of B is 0.9-1.1 wt. %, and the balance is T; and the anisotropic bonded magnet is formed by pressing a plurality of different preforms, and has a density deviation of less than 2% in a pressing direction; and the plurality of different preforms comprises a first preform and a second preform, wherein the first preform comprises a first composite magnetic powder with a lower magnetic property, the second preform comprises a second composite magnetic powder with a higher magnetic property, wherein the lower magnetic property and the higher magnetic property are of the first and second composite magnetic powders, respectively;

wherein the first and the second composite magnetic powders each comprise R-T-B type permanent magnetic powder, and the ratio of remanence Br of the first and second composite magnetic powders, respectively, is $Br_{high}/Br_{low}$, and the value of $Br_{high}/Br_{low}$ is greater than 1.00, and is less than or equal to 1.20, wherein $Br_{high}$ represents the remanence of the second composite magnetic powder with a high magnetic property, and $Br_{low}$ represents the remanence of the first composite magnetic powder with a lower magnetic property.

2. The anisotropic bonded magnet according to claim 1, wherein the plurality of different preforms comprises preforms having different densities.

3. The anisotropic bonded magnet according to claim 1, wherein R is one element or two or more elements selected from the group consisting of Y, Pr, Nd, Pm, Sm, Eu, Gd, Tb, Ho, Er, Tm, Yb and Lu.

4. The anisotropic bonded magnet according to claim 1, wherein the bonded magnet is a bonded magnetic ring having an aspect ratio of greater than 0.6, and a wall thickness of greater than 1 mm.

5. The anisotropic bonded magnet according to claim 2, wherein R is one element or two or more elements selected from the group consisting of Y, Pr, Nd, Pm, Sm, Eu, Gd, Tb, Ho, Er, Tm, Yb and Lu.

6. The anisotropic bonded magnet according to claim 2, wherein the bonded magnet is a bonded magnetic ring having an aspect ratio of greater than 0.6, and a wall thickness of greater than 1 mm.

7. The anisotropic bonded magnet according to claim 3, wherein R is Nd or PrNd.

8. The anisotropic bonded magnet according to claim 5, wherein R is Nd or PrNd.

9. The anisotropic bonded magnet according to claim 4, wherein the bonded magnet is a bonded magnetic ring having an aspect ratio of 1.0-10, and a wall thickness of 1-20 mm.

10. The anisotropic bonded magnet according to claim 6, wherein the bonded magnet is a bonded magnetic ring having an aspect ratio of 2-8, and a wall thickness of 1-5 mm.

11. The anisotropic bonded magnet according to claim 6, wherein the bonded magnet is a bonded magnetic ring having an aspect ratio of 1.0-10, and a wall thickness of 1-20 mm.

12. The anisotropic bonded magnet according to claim 4, wherein the bonded magnet is a bonded magnetic ring having an aspect ratio of 2-8, and a wall thickness of 1-5 mm.

13. A preparation method of the anisotropic bonded magnet according to claim 1, comprising the following steps:

step 1, preparing raw materials of the bonded magnet, wherein the raw materials comprise an R-T-B type permanent magnetic powder, a thermosetting resin binder, a coupling agent and a lubricant, wherein the weight content of the R-T-B type permanent magnetic powder is 100, the weight content of the binder is 1.0%-6.0% of that of the R-T-B type permanent magnetic powder, the weight content of the coupling agent is 0.05%-1.0% of that of the R-T-B type permanent magnetic powder, and the weight content of the lubricant is 0.05%-2.0% of that of the R-T-B type permanent magnetic powder;

step 2, mixing: uniformly mixing the R-T-B type permanent magnetic powder in the raw materials with the thermosetting resin binder, the coupling agent and the lubricant to acquire a composite magnetic powder;

step 3, pre-forming at room temperature: putting a plurality of composite magnetic powders having different remanence Br in a first mold and then placing the first mold in a magnetic field $H_1$ for press-forming to acquire a plurality of different preforms having different remanence Br, wherein a pressing pressure is 100-600 MPa, the magnetic field $H_1$ is less than 0.15 T, and a pressing temperature is room temperature;

step 4, warm-pressing and magnetic field orientation forming: stacking and putting the plurality of different preforms in a second mold and placing the second mold in a magnetic field $H_2$ for warm-pressing forming and orientation; performing pressing again; and afterwards, performing demagnetization, cooling and demolding to acquire an anisotropic bonded magnet subjected to warm-pressing and magnetic field orientation forming, wherein the intensity of the magnetic field $H_2$ is 0.6-3 T, the pressing pressure is 300-1000 MPa, and a forming temperature is 60-200° C.; and step 5, curing: heating the anisotropic bonded magnet subjected to warm-pressing and magnetic field orientation forming to certain temperature and then performing heat preservation, wherein the heat preservation temperature is 100-200° C. and the heat preservation time is 0.5-2 hours, wherein the plurality of different preforms comprises at least one first preform and at least one second preform, wherein the at least one first preform is prepared from a composite magnetic powder having a remanence $Br_{low}$, the at least one second preform is prepared from a composite magnetic powder having a remanence $Br_{high}$, and the ratio of remanence $Br_{high}/Br_{low}$ is greater than 1.00 and is less than or equal to 1.20.

14. The method according to claim 13, wherein the step 2 comprises:

dissolving the coupling agent metered in the above step in a corresponding organic solvent, and then uniformly mixing the same with the R-T-B type permanent magnetic powder, so that the surface of the permanent magnetic powder is coated with the coupling agent uniformly after the organic solvent is removed through volatilization; and then dissolving the thermosetting resin binder and lubricant in a corresponding organic solvent, and then uniformly mixing the same with the R-T-B type permanent magnetic powder coated with the coupling agent, so that the composite magnetic powder required for preparing the bonded magnet is acquired after the organic solvent is removed.

15. The method according to claim 13, wherein the first preform has a density less than that of the second preform.

16. The method according to claim 13, wherein stacking and putting the plurality of different preforms in the second mold in the step 4 comprises: putting the second preforms in the middle and the first preforms at two ends, wherein the second preforms in the middle have a length less than that of the first preforms at the two ends.

17. The method according to claim 13, wherein stacking and putting the plurality of different preforms in the second mold in the step 4 comprises: putting the second preforms in the center and the first preforms at the periphery.

18. The method according to claim 13, wherein stacking and putting the plurality of different preforms in the second mold comprises: the densities and/or remanences of the preforms arranged from a middle to two ends gradually decrease; or the densities and/or remanences of the preforms arranged from a center to a periphery gradually decrease.

19. The method according to claim 13, wherein in the step 4, a rate of gap between each preform of the plurality of different preforms and a warm-pressing and magnetic field orientation forming mold is 0.5-40%.

20. The method according to claim 17, wherein the first preform and the second preform are magnetic cylinders or magnetic rings having the same shape; and the ratio of the number of the first preforms to the number of the second preforms is 1:1-10:1.

21. The method according to claim 15, wherein stacking and putting the plurality of different preforms in the second mold in the step 4 comprises: putting the second preforms in the middle and the first preforms at two ends, wherein the second preforms in the middle have a length less than that of the first preforms at the two ends.

22. The method according to claim 15, wherein stacking and putting the plurality of different preforms in the second mold in the step 4 comprises: putting the second preforms in the center and the first preforms at the periphery.

23. The method according claim 14, wherein in the step 4, a rate of gap between each preform of the plurality of different preforms and a warm-pressing and magnetic field orientation forming mold is 0.5-40%.

24. The method according to claim 15, wherein in the step 4, a rate of gap between each preform of the plurality of different preforms and a warm-pressing and magnetic field orientation forming mold is 0.5-40%.

* * * * *